US005413371A

United States Patent [19]

Trimble

[11] Patent Number: 5,413,371

[45] **Date of Patent: * May 9, 1995**

[54] SKI BINDING BLOCK

[76] Inventor: Alan M. Trimble, 25445 Via Estudio, Laguna Niguel, Calif. 92677

[ * ] Notice: The portion of the term of this patent subsequent to Sep. 6, 2011 has been disclaimed.

[21] Appl. No.: 262,863

[22] Filed: Jun. 21, 1994

Related U.S. Application Data

[60] Division of Ser. No. 911,885, Jul. 10, 1992, Pat. No. 5,344,176, which is a continuation of Ser. No. 716,535, Jun. 17, 1991, abandoned.

[51] Int. Cl.[6] ..... A63C 5/07

[52] U.S. Cl. ..... 280/602; 280/607; 280/618; 280/636

[58] Field of Search ..... 280/602, 607, 618, 620, 280/633, 636, 11.14, 14.2

[56] References Cited

U.S. PATENT DOCUMENTS

| | | | |
|---|---|---|---|
| 2,258,046 | 10/1941 | Clement . | |
| 3,326,564 | 6/1967 | Heuvel . | |
| 3,797,844 | 3/1974 | Smolka et al. . | |
| 4,022,491 | 5/1977 | Powell | 280/618 |
| 4,804,200 | 2/1989 | Kuchler | 280/602 |
| 4,896,895 | 1/1990 | Bettosini . | |
| 5,056,808 | 10/1991 | Holzl et al. | 280/633 X |
| 5,251,923 | 10/1993 | Stepanek et al. | 280/602 |
| 5,332,252 | 7/1994 | LeMasson et al. | 280/602 |

FOREIGN PATENT DOCUMENTS

| | | |
|---|---|---|
| 0188985 | 7/1986 | European Pat. Off. . |
| 0344146 | 11/1989 | European Pat. Off. . |
| 0409749 | 1/1991 | European Pat. Off. . |
| 0454655 | 10/1991 | European Pat. Off. . |
| 0903433 | 2/1954 | Germany . |
| 3818569 | 4/1989 | Germany . |
| 3934891 | 5/1990 | Germany . |
| 0674155 | 5/1990 | Switzerland . |
| 8801190 | 2/1988 | WIPO . |

OTHER PUBLICATIONS

Sport-Schek Catalog, Winter Issue, Oct. 1989, p. 295, "DSVP" Derbyflex Anti Vibration System.

*Primary Examiner*—Brian L. Johnson
*Attorney, Agent, or Firm*—Gordon L. Peterson

[57] ABSTRACT

A binding block for elevating the binding on a snow ski in order to achieve increased turning leverage has a mid-region wherein maximum ski flexibility is permitted. In one embodiment, the binding block is comprised of two separate elements forming a gap between them in order to provide such maximum flexibility. The binding block is constructed from a lightweight, flexible yet compressible material so as to not inhibit the natural flexibility characteristics of the ski, while at the same time performing the desirable function of absorbing or dampening ski vibration. In another embodiment of the invention, the binding block is slidably mounted on the ski so as to move relative thereto in response to the flexing of the ski, thereby enhancing the flexibility of the ski and the "feel" thereof by the skier.

12 Claims, 2 Drawing Sheets

SKI BINDING BLOCK

This application is a division of Ser. No. 07/911,885, filed on Jul. 10, 1992 and entitled SKI BINDING BLOCK, now U.S. Pat. No. 5,344,176 which is a continuation of Ser. No. 07/716,535 filed Jun. 17, 1991, now abandoned

BACKGROUND OF THE INVENTION

The present invention relates to a ski binding block now U.S. Pat. No. 5,344,126 for elevating ski bindings on a snow ski in order to provide improved turning leverage, and, more particularly, to a ski binding system for dampening excessive vibration transmitted through the ski to the skier without decreasing the intended, natural flexibility of the ski.

It is well known in the sport of alpine snow skiing that turns and other maneuvers on the skis are accomplished by shifting the skier's weight to one side or the other. This shifting concentrates the weight of the skier on one edge of the ski while decreasing the force on the opposite edge, thereby causing the ski to turn. In a typical ski run, the weight is shifted back and forth, thus causing the skier to follow a somewhat zig-zag course down the ski slope. The greater the weight or force on the turning edge of the ski, the sharper the angle the skier can turn.

It has also been well known for some time that the force that a skier can apply to the turning edge of the ski can be increased by the use of binding blocks. A binding block is mounted on the top surface of the ski and below the ski bindings in order to elevate the skier on the ski. This elevation causes increased leverage for the skier as the weight is shifted back and forth. Thus, the binding block, in combination with the ski binding, ski boot, and the legs of the skier, act as a moment arm to increase the amount of force on the turning edge of the ski as the weight is shifted to that side during turning. Such improved turning leverage is particularly desirable among high performance skiers who are required to make very sharp turns during competitive ski races such as the downhill, slalom, giant slalom, super giant slalom and "extreme."

However, binding blocks of the prior art have not found particular favor among high performance skiers because they suffer from a number of disadvantages. In particular, such previous binding blocks comprise one piece plate designs which are relatively long. The plate is positioned on the center of the ski and both the toe and heel pieces of the binding are mounted on it. The plate, however, creates a negative flex pattern in the performance of the ski when attached to the ski in this manner. That is, snow skis are designed and constructed so as to exhibit certain advantageous structural characteristics while in use. Such characteristics include flexibility in both a longitudinal and axial directions. Thus, in use, a skier will feel the ski bond and flex from tip to tail, forming a U-shaped arc along the longitudinal length of the ski. The spring-like construction of the ski causes it to "counter-flex" in the opposite direction, returning the ski to its normal, horizontal orientation.

In addition, the skier will feel the ski flex torsionally in a twisting motion about the longitudinal axis of the ski. Previous binding plates, because of their metallic construction and the manner in which they are mounted to the skis, substantially diminish these ski flexibility characteristics. That is, the plate essentially thickens the cross section of the ski/plate in the area where the plate is mounted, thus resisting the bending of the ski. Therefore, the plates of the prior art create a "dead spot" in the ski in the area under the plate which is relatively rigid and non-flexible. As a result, the skier is unable to experience the "feel" of the skis as he or she normally would as the ski is carving an edge during a turning maneuver.

In addition, such previous plate designs are relatively heavy; an additional disadvantage to the skier. On the other hand, previous binding blocks usually provide the advantage of dampening the vibration or "chattering" that skiers often experience, particularly on icy surfaces. However, as explained above, binding blocks of previous design have the substantial disadvantage of over-dampening such vibration, to the extent that the flexibility and "feel" of the ski is diminished or eliminated altogether. For example, some expert skiers who have utilized previous binding blocks have reported that visual observation was necessary in order to determine if they were "on edge" while making a turn because the binding plate prevented them from feeling the orientation of the ski.

Thus, there is a need for a binding system which provides increased turning leverage and vibration dampening, without decreasing or eliminating ski flexibility.

SUMMARY OF THE INVENTION

The present invention comprises a binding system for dampening excessive vibration in a ski without decreasing the natural flexibility of the ski. The structural characteristics of the binding block of the present invention advantageously are closely matched to those of the ski itself, thus permitting the ski to bend and twist in its normal fashion. Thus, the binding block of the present invention does not over-dampen; although, it does provide the advantage of increased turning leverage available from binding blocks in general.

In order to preserve the natural flexibility of the ski, the binding block of the present invention is provided with a mid-region which permits greatly improved flexibility, in both bending and torsion. In addition, the material from which the binding block is constructed is light but compressible, thereby absorbing excessive vibration without inhibiting the performance of the ski. In fact, performance is enhanced because the turning leverage is improved without diminishing the "feel" of the ski.

In one embodiment of the present invention, the binding block is constructed in two separate pieces with a gap separating them, one piece being located under each binding component (toe and heel). Thus, in the mid-region of the binding block, there is maximum flexibility and no "dead spots." The gap separating the binding block components will vary according to different boot sole sizes.

The binding block of the present invention is preferably constructed from a high density foam material which is lightweight and compressive in order to absorb vibration; although, other materials exhibiting similar characteristics can also be successfully utilized. In addition, other materials can be combined with the high density foam in order to achieve particular results. For example, a hard, relatively stiff plastic can be laminated to one surface of the binding block in order to strengthen the surface of the binding block which receives the binding. In addition, a layer of rubber can be placed between the binding block and the ski, thus enhancing the dampening effect of the binding block. The nosepiece of the binding block can also be aerodynamically shaped in various configurations in order to decrease drag.

In another embodiment of the present invention, the binding block is designed so as to slide or "float" as the ski flexes and counter-flexes. In this embodiment, the binding block provides even greater flexibility than the binding block design described above. In fact, it provides even greater flexibility than that available from skis and normal bindings, without any binding block whatsoever. In addition, of course, with the present binding block, the added advantage of increased turning leverage is also available.

In the floating embodiment of the present invention, the block is provided with an internal sliding plate which reduces any stiffness or rigidity that may be caused by the binding block itself. In other words, the sliding plate allows the ski to flex virtually in its normal fashion. Furthermore, because of the two-piece construction of the floating block design, the ski bindings, and in particular the heel piece thereof, is permitted to work in its normal fashion to minimize ski rigidity. On the other hand, because the floating binding block will typically yield to the flexing and torsional movement of the ski before the binding heel piece does, even greater ski flexibility is achieved with the floating binding block of the present invention over that which is available with no binding block whatsoever. This phenomena can be explained in more detail as follows.

In regular ski construction, the ski manufacturer designs a ski to achieve the desired flexibility without regard to any bindings, boots, or other accessories that may be attached to the ski. It is the objective of the binding manufacturer to construct a binding that will not interfere with the natural flex patterns intended by the ski manufacturer. Because the boot sole is rigid and relatively non-flexible (which must be the case for safety reasons), binding manufacturers have developed a spring-loaded binding heel piece which does not inhibit the natural flexibility of the ski. Thus, as the ski begins to flex in its U-shaped arc, the distance between the toe piece of the binding and the heel piece thereof tends to be decreased because of the arc of the ski. However, because the sole of the boot is rigid and is mounted between the toe and heel pieces of the binding, this tendency for the latter two components of the binding to come together is prevented. In other words, the rigidity of the boot inhibits the natural flexibility of the ski.

In order to avoid this problem, binding manufacturers have provided heel pieces which are spring-loaded and mounted on tracks. The spring loading biases the heel piece in the forward direction. As the ski begins to bend, the heel piece of the binding experiences the compression force caused by the rigid boot sole responding to the bending of the ski. This compression force eventually overcomes the spring force of the heel piece and allows it to slide rearwardly on its track. Thus, the flexibility of the ski is not inhibited because the heel piece of the binding slides slightly toward the rear. However, it should be pointed out that the spring force acting on the heel piece is relatively strong. This is because, in order for the binding to perform its safety function, it must exert a forward pressure on the toe piece of the binding where the boot is released. As a result, because it is not necessary for this forward pressure to be exerted on the sliding plate of the binding block of the present invention, the rearward movement of the sliding plate occurs much earlier in the flexing process than that of the binding heel piece. Therefore, the flexibility of the ski is inhibited even less than that of ski/binding systems not utilizing any binding blocks whatsoever.

The floating design of this embodiment of the present invention also incorporates an inventive method for mounting the binding block on the ski. In accordance with this method, the sliding plates are first joined together rigidly by, preferably, a relatively non-flexible metallic plate. This plate is then securely mounted to the ski at the center thereof, which is the optimal location as determined by the ski manufacturer. This mounting thus locates the binding block with respect to the optimal position for the binding and boot on the ski. Thereafter, the coverings which house the sliding plates are placed over the plates and the boot bindings are mounted through the covers and into the sliding plates (but not into the skis). Thus, the toe and heel pieces of the binding are able to function independently and normally.

In summary, the binding block system of the present invention provides not only increased turning leverage and vibration dampening, but also permits improved ski flexibility.

DETAILED DESCRIPTION OF THE INVENTION

Figure 1:
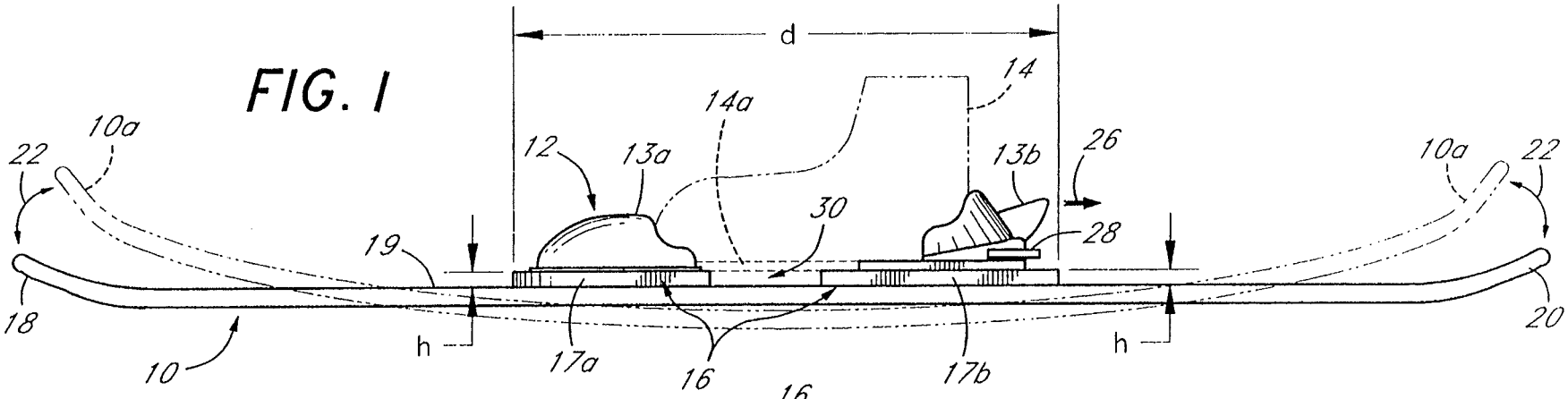
FIG. 1 is a side view of a typical ski having mounted thereon the binding block system of the present invention and showing in phantom lines the positioning of a typical ski boot and the U-shaped, arcuate bending movement of a ski while in use.

Referring to FIG. 1, there is shown a ski 10 of typical construction having mounted thereon a ski binding 12, including toe piece 13*a* and heel piece 13*b*. A typical ski boot 14 is shown in phantom lines as it would be positioned in the binding 12. The binding 12 is shown in FIG. 1 as being mounted upon the binding block 16 of the present invention, including toe block 17*a* and heel block 17*b*.

For ease of explanation, the present invention is being illustrated in connection with only a single ski 10; however, it will be understood that, typically, one binding block 16, including toe and heel blocks 17*a* and 17*b*, are applied to each ski, left and right. In addition, it should be noted that the binding block system of the present invention is compatible with a wide variety of ski and binding configurations and products, including without limitation standard alpine ski equipment. Moreover, the principles of the present invention are such that they can be incorporated into and integral with the binding itself.

Turning Leverage

Referring again to FIG. 1, it can be seen that the binding block 16 of the present invention elevates the binding (and therefore the ski boot 14) a slight distance "h" above the top surface 19 of the ski. This elevation provides improved turning leverage for the skier as his weight is shifted back and forth, left and right, from one edge of the ski to the other, during turning maneuvers. In other words, the distance h increases the constructive moment arm (comprising the binding 12, ski boot 14, and legs of the skier) when the weight of the skier is shifted to one side. Therefore, the skier is able to exert a greater force on that edge of the ski in order to carve a tighter or sharper turn. For high performance skiers, whose competitive race times are measured in hundredths of seconds, even this seemingly small advantage can make the difference between winning and losing.

Ski Flexibility and Binding Design

In addition to the increased turning leverage, as explained above, the binding block 16 of the present invention also advantageously does not inhibit, and in fact enhances, the natural flexibility of the ski 10, in both bending and torsion. For purposes of this application, the term "flexibility" refers to the characteristic of the ski, as designed by the manufacturer, to both bend longitudinally and to twist about its longitudinal axis. Referring to FIG. 1, the ski's bending characteristic is illustrated by the phantom lines 10*a*. In other words, while in use, and particularly in high performance skiing, the ski 10 experiences tremendous forces which distort its normal, essentially planar shape. For example, the ends of the ski, including the tip 18 and the tail 20, tend to flex upwardly in a U-shaped arcuate configuration as shown by the phantom lines 10*a* in FIG. 1. Because of the spring-like nature of the ski (which behaves, in essence, similar to a plate spring), the ski is constantly flexing along its longitudinal length in an upward U-shaped manner, and "counter-flexing" back to its original, essentially horizontal position, as indicated by the double headed arrows 22.

Figure 1A:
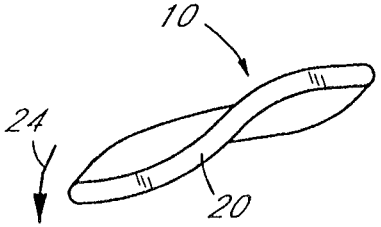
FIG. 1*a* is a perspective end view of a ski illustrating the torsional flexibility frequently experienced by a ski while in use.

Referring to FIG. 1*a*, the flexible characteristic of the ski 10 to twist about its longitudinal axis is illustrated. In this end view of the tail 20 of the ski, the ski tends to twist under the effect of the torsional forces exerted thereon, as indicated by the arrows 24.

These flexibility characteristics are desirable and are intended by the ski's manufacturers. Such flexibility provides for increased velocity on the slope and allows the skier to "feel" the position of the skis beneath him or her. This feature is important, as it allows the skier to quickly react to the conditions of the slope as he or she races at high speeds down the hill.

In addition, these flexibility characteristics are designed by the manufacturers of the ski without regard to the binding or boot that may be mounted thereon. In other words, it is expected that the binding should be constructed so as not to interfere with or inhibit the natural flexibility of the ski. However, as will be obvious from FIG. 1, the rigidity of the ski boot sole 14*a*, when mounted on the ski 10 by virtue of the binding 12, will have the obvious result of decreasing the flexibility of the ski, at least in the region below the boot. As a result, the flexibility at the tip 18 and tail 20 of the ski will be inhibited.

Accordingly, as shown in FIG. 1, binding manufacturers have provided a spring-loaded heel piece 13*b* which reacts to the flexing of the ski by moving rearward (in the direction of arrow 26) along a track 28. In other words, as the ski flexes in accordance with the phantom lines 10*a* of FIG. 1, in the absence of the ski boot 14, the toe and heel pieces 13*a* and 13*b* of the binding 12 would tend to approach one another due to the arc formed by the ski. In other words, if one imagines attempting to touch the tip 18 and the tail 20 of the ski 10 together, the toe piece 13*a* and heel piece 13*b* of the binding 12 would tend to approach one another (i.e., the distance separating them is decreased) due to the arc formed by the bending of the ski. However, because of the rigidity of the ski boot sole 14*a*, the distance separating the toe and heel pieces of the binding 12 cannot be decreased. Under normal conditions, this condition significantly reduces the flexibility of the ski and produces a "dead spot" beneath the boot, wherein the skier is unable to feel the position of the skis on one edge or the other beneath his boot. As a result, the skier's performance is diminished.

Thus, current binding design provides a heel piece 12 which is spring-loaded so as to be biased in the forward direction. When the ski 10 begins to flex, as shown in FIG. 1, the compression experienced by the ski boot 14 as the toe and heel pieces 13*a* and 13*b* of the binding 12 approach one another is resisted by the rigidity of the ski boot sole 14*a*. If the compression force is great enough, the spring force of the heel piece 13*b* is overcome, thus allowing the heel piece to slide rearwardly on the track 28 in the direction of the arrow 26. Thus, the flexibility of the ski is not inhibited as the heel piece 13*b* releases and slides toward the tail 20.

However, the spring force acting on the heel piece 13*b* is relatively strong due to the requirement that the heel piece exert forward pressure on the boot 14. This forward pressure is necessary in order to permit the binding to accomplish its normal safety function; that is, the binding releases at the toe piece 13*a*, and a decrease in forward pressure would dangerously inhibit the boot 14 from releasing. Therefore, although the slidable heel piece 13*b* of the binding does permit the ski to exhibit its natural flexibility characteristics, the relatively strong spring loading of the heel piece nevertheless inhibits ski flexibility over a significant portion of the bending spectrum until such time as the heel piece 13*b* releases.

Improved Flexibility

With previous binding block designs, wherein a single relatively stiff plate was utilized to mount the toe and heel pieces of the binding, the flexibility of the ski was greatly diminished. In particular, even the releasable heel piece of the binding was not permitted to act in its normal fashion because the flexibility of the ski was inhibited by the binding plate. Furthermore, previous binding plates, which are typically constructed from metal, also add to the weight of the binding system, thus further diminishing the skier's performance.

As shown in FIG. 1, the binding block system 16 of the present invention provides for maximum flexibility in the ski 10 by providing a mid region which is highly flexible. This feature allows the ski 10 to exhibit its natural flexibility characteristics. As shown in FIG. 1, in one embodiment of the invention, the binding block 16 of the present invention is provided with a complete gap or space 30 between the toe block 17*a* and heel block 17*b*, thus permitting maximum flexibility. That is, the present binding block 16 stiffens the ski 10, if at all, to no greater extent than the binding 12 itself. Furthermore, because of the enhanced flexibility of the ski, the releasable heel piece 13*b* of the binding is permitted to function normally.

However, it should be pointed out that other configurations and mechanical connections in the mid-region 30 of the binding block 17*b*, between the toe and heel blocks 17*a* and 17*b* thereof, can be utilized in order to take advantage of the principles of the present invention.

The Present Binding Block

Figure 2:
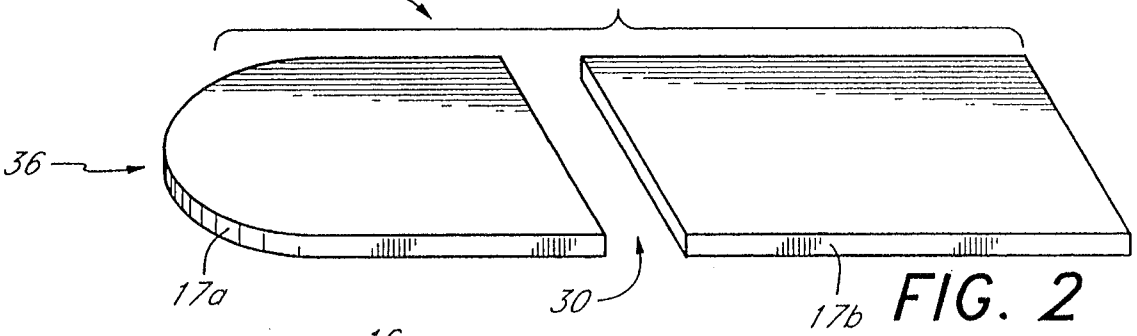
FIG. 2 is a perspective view of the binding block of the present invention illustrating a mid region (in this case, a complete gap) which provides maximum flexibility for the ski.

FIG. 2 illustrates a close up perspective view of one embodiment of the binding block system 16 of the present invention. In this embodiment, the invention comprises a toe block 17*a* and heel block 17*b* for mounting the toe and heel pieces 13*a* and 13*b*, respectively, on the binding, as shown in FIG. 1. Each block 17*a* and 17*b* is relatively planar and has the same approximate width as that of the ski 10, i.e., about two to three inches. Each block component will vary in length according to the boot size to be applied thereon. However, the overall length, including toe and heel blocks 17*a* and 17*b* and gap 30, will typically fall in the range of 16–24". The height also will vary depending upon the application or type of race in which the skier is engaged. A preferred height range is ¼" to ¾". The preferred dimensions would be 18" long by 2 ½" wide by ½" thick. The gap or space 30 between the toe and heel blocks 17*a* and 17*b* of the present invention will also vary depending upon different boot sole sizes.

The binding block 16 of the present invention is advantageously constructed from a lightweight material which, at the same time, is also somewhat flexible and absorbs vibration and shock transmitted to the block 16 through the ski 10. These absorption characteristics assist in dampening such vibration and in minimizing the lost energy and discomfort to the skier resulting therefrom. Preferably, the present binding block 16 is constructed from a high density polyurethane foam material which displays the advantages of flexibility and compressibility mentioned above, while at the same time being strong and rigid enough to hold up to the punishment of the shock and vibration experienced by the ski. The density of the foam can vary according to the application; however, the general range is 30–50 pounds per cubic foot with a preferred density of 40 pounds per cubic foot. One example of suitable material is Last-A-Form FR-3740 manufactured by General Plastics Manufacturing Co., of Taconea, Wash. Other nonmetallic products exhibiting these characteristics are compatible with the principles of the present invention.

Figure 3:
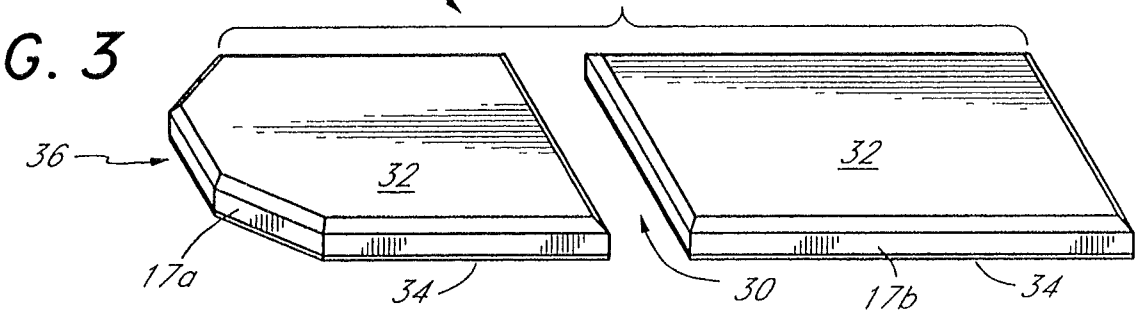
FIG. 3 is a perspective view of the binding block system of the present invention illustrating the manner in which various materials can be combined with the blocks to achieve desired characteristics.

FIG. 3 illustrates another embodiment of the present invention 16 which utilizes other materials in order to achieve additional advantages. For example, the top surface 32 of the binding block 16 can be provided with a relatively rigid plastic material, such as ABS plastic. This material provides a finished top which is smooth, and is an ideal binding mounting surface. This material also enhances the dampening characteristics of the present binding block 16.

Mounted on the bottom surface of the binding block 16, as shown in FIG. 3, is a layer of rubber material or other highly shock-absorptive material 34 for dampening vibration. The use and combination of these various materials will depend upon the amount of dampening required under certain conditions.

In general, a ski that is traveling fast down the slope will experience more chatter and vibration. Therefore, it is desirable to use binding blocks 16 which are relatively long, thereby increasing the dampening material mounted on the ski and minimizing the negative energy transmitted to the skier. Shorter binding blocks 16 are utilized in skis, such as slalom skis, which make sharp turns and travel at a lower velocity. Thus, the various dimensions of the present binding block 16 can be adjusted to achieve the desired conditions on the slope. An important advantage of the present invention is that the binding block material dampens vibration but does not over-dampen, thereby permitting the natural flexibility characteristics of the skis to be exhibited.

It will be noted from FIGS. 2 and 3 that the nose portion 36 of the toe block 17*a* is aerodynamically shaped in order to reduce drag. Many other shapes and configurations are possible in order to achieve this advantage of the present invention.

The binding block system 16 of the present invention is approximately ⅓ the weight of previous metallic binding plate systems. Therefore, there is less "swing weight" for the skier to overcome as the weight is shifted back and forth during turning. As a result, the skier preserves energy and is does not become fatigued as fast as with previous metallic plate systems.

Another advantage of the present invention is that the binding blocks 16 mount to the ski 10 in combination with the bindings 12 in their normal fashion. That is, the jig (not shown) provided by the binding manufacturer is still utilized for positioning the bindings 12 and their corresponding binding blocks 16 to the ski. The only modification in the binding mounting procedure is that slightly longer screws are necessary in order to mount the binding 12 through the block 16 and into the ski 10.

The Floating Binding Block Embodiment

Figure 4:
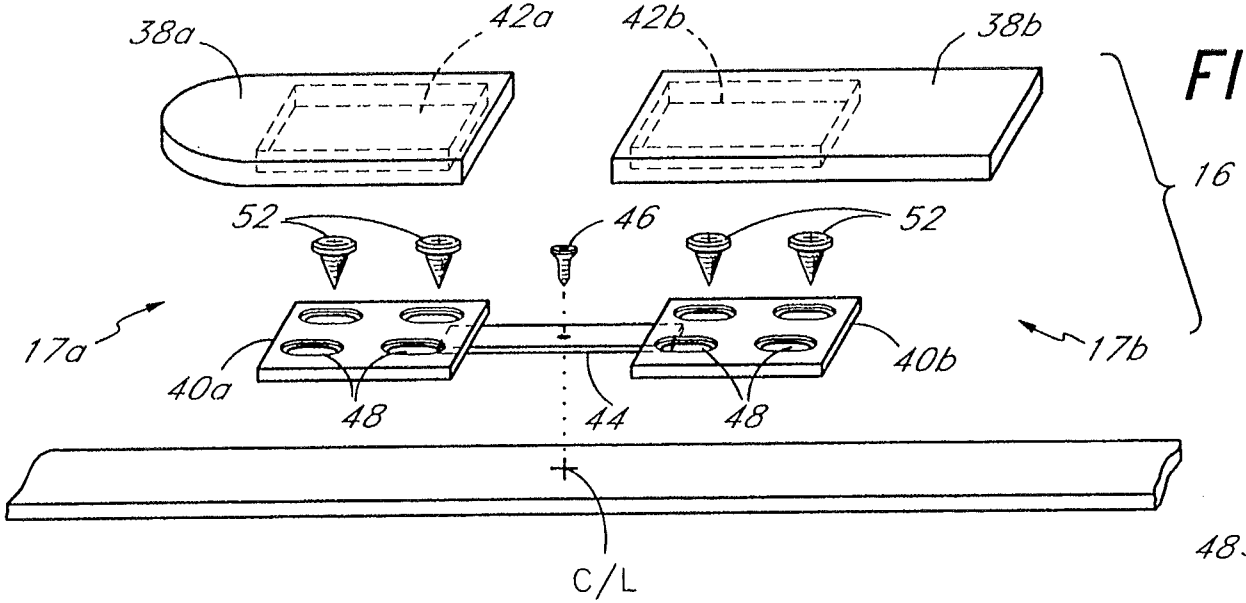
FIG. 4 is an exploded perspective view of the sliding or "floating" embodiment of the binding block of the present invention illustrating the sliding plates and their respective block covers.

FIG. 4 illustrates another embodiment of the present invention in which the binding block 16 slides or "floats" in response to the flexing of the ski 10. Therefore, since the present binding block presents very little rigidity or stiffness to the ski, the ski is able to exhibit its normal flexibility characteristics, providing excellent feel and sensation to the skier. In fact, tests have shown that this embodiment of the present invention provides greater than normal flexibility than that possible with a typical ski/binding system not utilizing a binding block.

Because of its slidable mounting, the binding block 16 of FIG. 4 yields to the flex of the ski 10 easier and sooner than the spring-loaded heel piece 13*b* of the binding, thereby enhancing the flexibility of the ski. The operation of this slidable feature is explained below in more detail in connection with FIG. 6.

Figure 5:
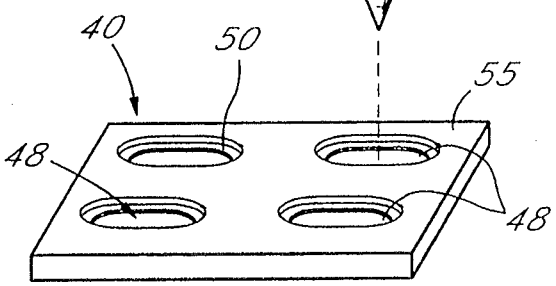
FIG. 5 is a close up perspective view of one of the sliding plates of FIG. 4 illustrating the construction of the slotted openings for slidably fastening the sliding plates to the ski with a fastener of special design.

The construction of the slidable binding block 16 of the present invention is illustrated in FIGS. 4 and 5. The binding block 16 is preferably comprised of a four-piece construction, as shown in FIG. 4, with each block component comprising two pieces each. Thus, the toe block 17*a* is comprised of an upper housing 38*a* and a sliding plate 40*a*, and the rear block 16 is also comprised of an upper housing 38*b* and a sliding plate 40*b*. However, it should be pointed out that other block configurations are possible in order to achieve the slidable advantages of this embodiment. In fact, the principles of invention incorporated in this embodiment are achievable without the housing elements 38*a* and 38*b*.

Each sliding plate 40*a* or 40*b* is constructed so as to be nested within a recessed opening 42*a* or 42*b* formed on the bottom surface of the housings 38*a,b*, respectively. The recessed opening 42 has approximately the same depth as the thickness of the sliding plate 40 so that the two components, when mounted together on the surface of the ski 10, present a generally flush surface. Furthermore, the recessed opening 42 on the bottom of the housing 38 is dimensioned so as to snugly receive the sliding plate 40. The top surface of the housing 38 presents a smooth surface so that the binding block 16 of FIG. 4, when mounted on the ski 10, will give the same general appearance as that shown in FIG. 1. Although the sliding plate 40 is shown to be generally rectangular and planar, other configurations are possible in order to achieve the advantages of the present invention.

Each housing 38 is preferably constructed from the same high density polyurethane foam as the binding blocks 16 described in connection with FIGS. 1–3. Furthermore, other materials, such as ABS plastic and/or rubber, can be combined with the housing 38 in order to accomplish the advantages described in connection with FIG. 3 above. The sliding plate 40 is preferably constructed from a self-lubricating, relatively tough material in order to reduce friction and to provide strength for the mounting of the binding blocks 16 and bindings 12 on the ski 10. In addition, the sliding plate 40 also exhibits flexibility and dampening characteristics. One material which has shown to be ideal for these conditions is DELRIN, material a trademark of DuPont; however, other similar materials are suitable.

The construction and method of mounting the binding block 16 of FIGS. 4 and 5 will now be explained. It will be noted from FIG. 4that the sliding plates 40*a* and 40*b* are joined together in their central regions by a relatively strong and rigid strip 44. Preferably, this strip 44 is constructed from a metallic material, such as stainless steel or some other strong metal. The metallic strip 44 is attached to the bottom surface of the sliding plates 40 by fasteners (not shown) in such a manner that provides a smooth, flush bottom surface on the sliding plates 40. Thus, the metallic strip 44 locates the sliding plates 40 relative to each other.

The strip 44 is then fastened by fastener 46 (only one of which is shown in FIG. 4) to the ski 10 at the center line, as shown in FIG. 4. This location, which is the center of the running surface of the ski, is the optimum location for positioning the binding 12 and ski boot 14, as intended by the ski manufacturer. Thus, the metallic strip 44 locates the binding block 16 and eventually the bindings 12 and ski boot 14, in the optimum position on the ski 10. As explained in more detail below, the metallic strip 44, in combination with the flexing of the ski, produces the sliding or floating characteristic of the binding block 16 of FIG. 4.

As shown in FIGS. 4 and 5, each sliding plate 40*a* or 40*b* is provided with four slotted openings 48 for slidably mounting the plates to the ski 10. Although four such openings 48 are shown, a fewer number of openings are also possible in order to achieve the purposes of the present invention. In fact, the elimination of the inner pair of slotted openings 48 would increase the flexibility of the ski.

As shown in FIG. 5, the slotted openings 48 are provided with recessed shoulders 50 for receiving a shoulder screw 52, one of which is shown in FIG. 5. The recessed shoulder 50 permits the head 54 of the shoulder screw 52 to be recessed below the top surface 55 of the sliding plate 40 so that the housing 38 can be flushly mounted thereon. As shown in FIG. 5, the fastener 52 is chamfered and rounded along the lower portions of its head 54 in order to facilitate the sliding movement of the plate 40. As explained in more detail below, this screw configuration 52 also reduces friction and wear on the slotted openings 48 of the sliding plate 38 as it slides and flexes in response to the flexing of the ski. Thus, if the fasteners 52 are not over-tightened, they cooperate with the slotted openings 48 to provide a coupling which permits the sliding plate 40 to slide in response to the flexing of the ski.

Once the sliding plates 40 are fixed to the ski 10 at the center line by means of fasteners 46 and slidably mounted on the ski by means of the four fasteners 52 in combination with the slotted openings 48, the housings 38 are then snugly fit down over the top of the sliding plates 40 so that the plates are nested within the recessed openings 42. It should be pointed out that each housing 38 is press-fit onto the sliding plate 40 and is not independently mounted on the ski. The binding 12 is then mounted to the sliding plate 40 through the housing 38, with the regular fastener (not shown) supplied by the binding manufacturer. However, for reasons which will become apparent below, the binding 12 is not fixed to the surface of the ski.

The Operation of the Floating Block

The operation of the floating binding block 16 of FIGS. 4 and 5 may be illustrated in connection with FIG. 6 and explained in the context of the above section entitled "Ski Flexibility and Binding Design."

In the unflexed, horizontal position of the ski 10, the binding block 16 spans a distance "d" from the tip of the toe block 17*a* to the tail of the heel block 17*b*, as seen in FIG. 1. However, as the ski 10 begins to flex in the direction of the arrows 56 shown in FIG. 6, the distance d1 tends to shorten due to the curvature of the ski 10. This flexing applies a compressive force to the binding block 16 causing it to bend and flex to some degree. Advantageously, because of the materials from which the housing 38 and sliding plate 40 are constructed, the binding block 16 does itself exhibit flexibility characteristics in response to such compressive force, thereby permitting the ski to flex.

This compressive force also causes the fasteners 52 to move in the slotted openings 48 of the sliding plates 40. Although the sliding plates 40 are fixed to the surface of the ski 10 by means of the central metallic strip fasteners 46, the relative movement of the sliding plates 40 with respect to the ski 10 is in the direction of the arrows 58 shown in FIG. 6. This movement of the sliding plates 40 relative to the bending of the ski 10 permits the ski to flex in its normal fashion. Furthermore, there is very little resistance on the part of the sliding plate 40 to this movement, thereby readily permitting the ski to flex. This is in contrast to the relatively strong spring-loaded heel piece of the binding which substantially resists the compressive force of the ski flex, thereby inhibiting ski flexibility. Accordingly, the slidable binding block of FIGS. 4–6 enhances the flexibility of the ski even over that of the normal ski/binding configuration.

Figure 6:
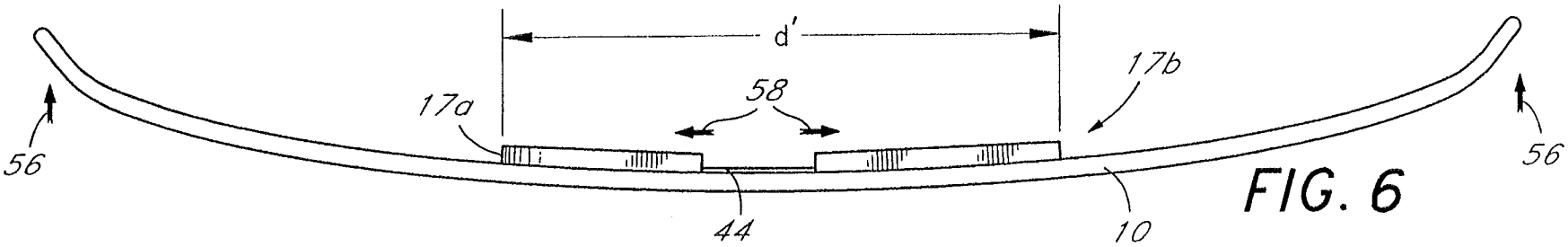
FIG. 6 is a schematic view illustrating the operation of the floating binding block of the present invention.

It should be noted in connection with FIGS. 4–6, that the housing 38, not being fixed to the ski surface, is permitted to slide along with the sliding plates 40 over which they are mounted. Furthermore, since the bindings 12 are mounted to the sliding plates 40 and not to the ski, the same relative movement of the binding 12 is permitted so as to not interfere with its normal function. That is, if the ski experiences sufficient flex such that fasteners 52 move in their slotted openings 48 to the maximum extent permitted by said openings, additional flex can still be accommodated by the heel piece 13*b* of the binding as it moves on its track 28. Accordingly, a wide range of flexibility is provided.

It will be observed that the relative mechanical movement of the sliding plate 40 with respect to the ski 10 is somewhat complex in its nature. Although it has been described herein as a "sliding" movement, there is also movement in the transverse direction. That is, the sliding plate and housing combination will experience some flexing itself in response to the compressive force caused by the ski binding, as mentioned above. Furthermore, because the fasteners 52 are installed in their slotted openings 48 in a direction which is perpendicular or normal to the top surface of the ski, this orientation will be maintained as the ski flexes. Therefore, the fastener 52 will become canted or angled in the slotted opening 48 to the extent that the ski flexes more than the sliding plate. Thus, it is important that the head 54 of the fastener 52 be chamfered (as indicated at 60 in FIG. 5) in order to allow it to rock back and forth in the slotted opening 48 as the ski flexes and counterflexes. The fastener 52 will thus experience both sliding and rocking movement in the slotted opening 48. For these reasons, the self-lubricating material for which the sliding plate 40 is constructed will, in combination with the configuration of the fastener head 54, reduce wear and friction as this relative movement occurs. Likewise, the movement of the sliding plate 40 on the surface of the ski will be improved by the self-lubricating nature of the bottom surface of the sliding plate.

In summary, the binding block of the present invention provides vastly improved ski performance over previous binding plate designs. As has been pointed out throughout this application, although the principles of the present invention have been illustrated by reference to a few preferred embodiments thereof, other embodiments that are apparent to those of ordinary skill in the art are also within the scope of the invention. Accordingly, the scope of the invention is intended to be defined only by reference to the appended claims and those of all continuing applications.

I claim:

1. A ski assembly comprising:

an elongated ski which can flex, said ski having an upper surface;

an elongated binding block extending longitudinally along the upper surface of the ski and adapted to have a ski binding mounted thereon, said binding block having opposite ends;

an attachment fixing the binding block to the ski at a location intermediate the ends of the binding block; and longitudinally elongated regions of said binding block on opposite sides of said location being free to move longitudinally relative to the ski as the ski flexes.

2. A ski assembly as defined in claim 1 including a coupling for coupling the binding block to the ski on one side of said location to allow the binding block to move longitudinally relative to the ski.

3. A ski assembly as defined in claim 2 including a second coupling for coupling the binding block to the ski on a side of said location opposite said one side to allow the binding block to move longitudinally relative to the ski.

4. A ski assembly as defined in claim 2 wherein the coupling includes a longitudinal slot in the binding block and a fastener receivable in the slot with the fastener being movable in the slot to allow the longitudinal relative movement between the binding block and the ski.

5. A ski assembly as defined in claim 1 wherein said location is at a central portion of the binding block.

6. A ski assembly as defined in claim 2 wherein said attachment includes a threaded fastener fixing the binding block to the ski at said location.

7. A ski assembly as defined in claim 1 wherein the binding block includes first and second plates on opposite sides of said location, said plates being free to move relative to the ski as the ski flexes.

8. A ski assembly as defined in claim 1 wherein said ends of the binding block are unrestrained in said movement longitudinally relative to the ski.

9. A ski assembly as defined in claim 1 wherein the binding block includes compressible material for absorbing shock and vibration from the ski.

10. An assembly for attachment to a ski comprising:

an elongated binding block adapted for attachment to a ski and adapted to have a ski binding mounted thereon, said binding block having opposite ends;

a fastener for fixing the binding block to the ski at a location intermediate the ends of the binding block;

a first coupling for coupling the binding block to the ski on one side of said location to allow the binding block to be movable longitudinally relative to the ski; and a second coupling for coupling the binding block to the ski on the other side of said location to allow the binding block to be movable longitudinally relative to the ski.

11. An assembly as defined in claim 10 wherein the first coupling includes a longitudinal slot in the binding block and a fastener receivable in the slot and attachable to the ski.

12. An assembly as defined in claim 11 wherein the second coupling includes a longitudinal slot in the binding block and a fastener receivable in the slot and attachable to the ski.

* * * * *